United States Patent [19]

Maupas

[11] 4,340,794

[45] Jul. 20, 1982

[54] SEMI-CONDUCTOR FOR HIGH CONTINUOUS CURRENTS

[76] Inventor: Bernard V. Maupas, Corserey, Corserey, Canton de Fribourg, Switzerland, CH-1751

[21] Appl. No.: 169,119

[22] PCT Filed: Feb. 28, 1979

[86] PCT No.: PCT/CH79/00033

§ 371 Date: Nov. 1, 1979

§ 102(e) Date: Nov. 1, 1979

[87] PCT Pub. No.: WO79/00670

PCT Pub. Date: Sep. 6, 1979

[30] Foreign Application Priority Data

Mar. 1, 1978 [CH] Switzerland ..... 2175/78

[51] Int. Cl.[3] ..... H01H 9/52

[52] U.S. Cl. ..... 200/289; 200/16 A; 200/153 LB

[58] Field of Search ..... 200/289, 16 R, 16 A, 200/281, 153 L, 153 LB

[56] References Cited

U.S. PATENT DOCUMENTS

| | | | |
|---|---|---|---|
| 2,933,577 | 4/1960 | Wintel et al. | 200/16 A |
| 3,045,092 | 7/1962 | Bundy | 200/16 A |
| 3,852,544 | 12/1974 | Grunert et al. | 200/289 |
| 4,025,738 | 5/1977 | Erwin et al. | 200/153 LB |
| 4,064,381 | 12/1977 | Mullen et al. | 200/16 A |
| 4,160,885 | 7/1979 | Ellicott et al. | 200/153 LB |

*Primary Examiner*—Willis Little

[57] ABSTRACT

A unipolar short-circuiter for high direct current at low voltage permits disconnecting of any of the cells of a series of electrolytic cells, for the production of chlorine or aluminum, for example, without disturbing or interrupting the functioning of the other cells. The short-circuiter according to the invention is equipped with two sets of movable contacts (26,32) controlled by a common shaft (24) and cooperating with two groups of current conductors having a deformable part (3,4,16,17) and cooled by circulation of water in the enclosures (9,22). FIG. 1.

7 Claims, 5 Drawing Figures

SEMI-CONDUCTOR FOR HIGH CONTINUOUS CURRENTS

In electro-chemical installations, for production of chlorine for example, or installations for electrolytic refining of metals, it is necessary to be able to break the circuit of one of numerous production cells arranged in a series in order to proceed to maintenance or replacement, without stopping the production of the installation.

In certain procedures, there is used a displaceable disconnector known as a short-circuiter, capable of being connected electrically, in an "open" position, to two production cells connected to the cell to be short-circuited. In a "closed" position, the short-circuiter maintains the current of the installation and puts out of service the short-circuited cell which can be disconnected and taken out without disturbing the regular operation of the other cells.

The short-circuiter has two current-taking plates which are connected, directly or by means of connecting pieces, onto connecting areas of each of the cells. The plates for taking the current, which are generally connected by bolts onto the cells, are connected to the semi-conductor device, properly speaking, by means of deformable conductive parts which have the effect of compensating for variations of geometry of the different production cells, and also sometimes of permitting displacement of the current-taking plates toward the connecting areas.

In short-circuiter models for known high currents, the conducting parts are cooled by circulation of water through conduits in the solid conductive pieces or in tubes brazed to the conductive parts. The known devices are relatively complex and in addition are poorly adapted to the very high currents, from 100 to 150 kA, which are used in the most modern cells for electrolysis.

The short-circuiter for high direct currents with low voltage which is the object of the present invention is characterized by the presence of two sets of movable contact pieces working with two groups of two stationary contact plates. The overall arrangement, including the driving mechanism of the movable contact pieces, being symmetrical in relation to the axis of the driving shaft of the movable contact pieces which is thereby submitted only to torsion forces. Each of the groups of two stationary contact plates are connected by deformable conductor elements to one of the current taking plates in order to constitute an assembly surrounded by an enclosure in which a cooling liquid circulates. The only parts of said assembly outside this enclosure are the stationary contact plates cooperating with the movable contact pieces, on the one hand, and the current taking plates cooperating with the connection area of the affected cell on the other hand. Said enclosure includes a flexible, deformable portion to permit a slight movement of the current taking plate in relation to the fixed contact plates in order to compensate for the imprecisions of construction of the cells.

In the short-circuiter according to the invention, the two conductive parts, with their cooling enclosures, as well as two sets of the movable contact pieces with their mechanism and their control shaft are carried by a chassis from which they are electrically insulated, said chassis being able to rest on the ground or even be suspended by two pivots to a strap in which it can move, the strap itself being suspended either from a trackway with rollers, or from a portico.

The two enclosures surrounding the two conductive parts of the short-circuiter, as provided in this invention, permit obtaining a large heat-exchanger surface between the conductors and the cooling liquid. It is possible to increase this exchange surface, by providing the two stationary contact plates with metallic fins in contact with the cooling liquid.

When the cooling liquid is water, one advantage of the cooling enclosure, according to the invention, is that the volume of cooling water contained in the short-circuiter is sufficient so that a reduction or even a temporary stopping of the circulation of water is not inconvenient, because the evacuation of the calories produced by the Joule effect can be assured at the moment by the vaporization of a part of this water, without endangering short-circuiter.

In one method of carrying out the objective of the short-circuiter of the present invention, each movable contact piece is driven through a pre-tightened compression spring, by means of a crank-shaft attached to a sliding piece guided in two insulator pieces. One of the insulator pieces is located near the movable contact involved, the other being located near the set of symmetrical movable contacts. The latter guiding arrangement is close to the attachment point of the crank on said sliding piece, with the crankpins carried by the single control shaft being involved alternately with one and the other of the two sets of movable contacts. In such an embodiment of the invention, the movable contacts are insulated from their control mechanism and are insulated from each other, so that no transitory circulation of current is possible between any two of the movable contacts.

According to the invention, each of the two sets of movable contacts includes, preferably, at least one special breaking contact which is established before the ordinary contacts and which opens after said ordinary contacts. The supporting course of these breaking contacts, which are also called sacrifice contacts, is much longer when they are new, than that of ordinary contacts, so that they can be used without the ordinary contacts closing or opening the current of the cells to be short-circuited.

In one particular method of carrying out the invention, the breaking contacts have a width which is double that of ordinary contacts and are controlled by two crank-shafts and two springs which are more flexible than the single spring of ordinary contacts.

One can foresee, in the area of zones of contact of the breaking contact, on the one hand, protective partitions designed to prevent the spraying of metallic droplets toward ordinary contacts or toward the control mechanism of the breaking contact, and on the other hand, designed to collect the spraying of droplets blocked or deflected by said partitions which are fixed or carried by the movable breaking contact and are resistant to sprays at high temperatures, such as melamine glass for an insulating partition between the breaking contact and an ordinary contact, or such as steel for the two fixed or movable deflectors designed to prevent metallic droplets coming from the break being sprayed onto a tie rod of the movable contact or the adjustment stop for the compression path of its spring.

In one particular embodiment of the breaking contact, the movable contact carries two metallic deflectors, for example of stainless steel, each working with a recess located, at its foot, in the movable contact, in order to serve as collector sprays blocked by said deflector, the sprays deflected by it being placed in a recess arranged opposite the deflector, in the stationary part. In another embodiment of the invention, recess are arranged in the movable breaking contact, between it and the insulating partitions for protection of the adjacent ordinary contacts, to collect the metallic sprays issued from the breaking contacts, without without disturbing the latter in movement of the movable contact.

Additional advantages and features of the invention will be apparent to those skilled in the art from the following detailed description thereof, taken together with the accompanying drawings in which.

Figure 1:
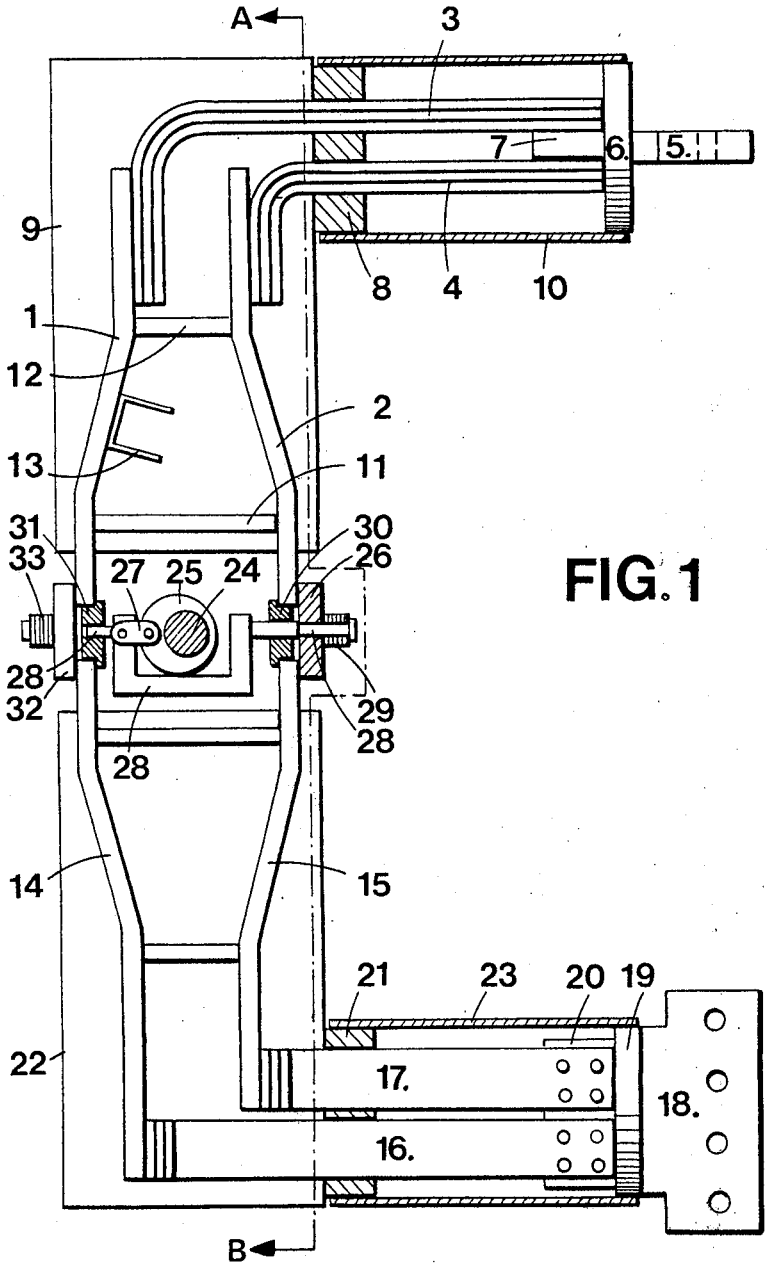
FIG. 1 is a schematic view, partly in section of the short-circuiter of the present invention.

The chassis which carries the parts shown of the short-circuiter, the control mechanism of the driving shaft of the movable contacts, as well as the elements of the cooling circuit of the two enclosures in which the active stationary parts are bathed, are not shown in the drawings since all of these parts can be made by known means while remaining within the scope of the invention.

FIG. 1 shows two stationary contact plates 1 and 2, connected respectively by flexible conductors 3 and 4 to a vertical current-taking plate 5. This plate is provided with a cylindrical collar 6 and with a vertical connection piece 7 to the flexible conductors. The collar 6 is connected to a collar 8 of the body of the cooling enclosure 9 by a cylindrical flexible sleeve 10 preferably of clothlined rubber. The two stationary contact plates 1 and 2 are interconnected by crossbraces have fins 11 and 12. These plates have fins 13 which increase the surface heat exchange with the cooling fluid. The two other stationary contact plates 14 and 15 are connected by flexible conductors 16 and 17 to the connection piece 20 of a horizontal current taking plate 18 whose collar 19 is connected to the collar 21 of the body 22 of the cooling enclosure by a flexible sleeve 23.

FIG. 1 shows the control shaft 24 which carries a disc 25 which drives a stationary contact 26 by means of a link 27 a bent sliding piece 28 and a compression spring 29. The sliding piece 28 is guided in insulating pieces 30 and 31.

The driving mechanism of the movable contact 32 by means of its pre-tightened compression spring 33 is not shown.

Figure 2:
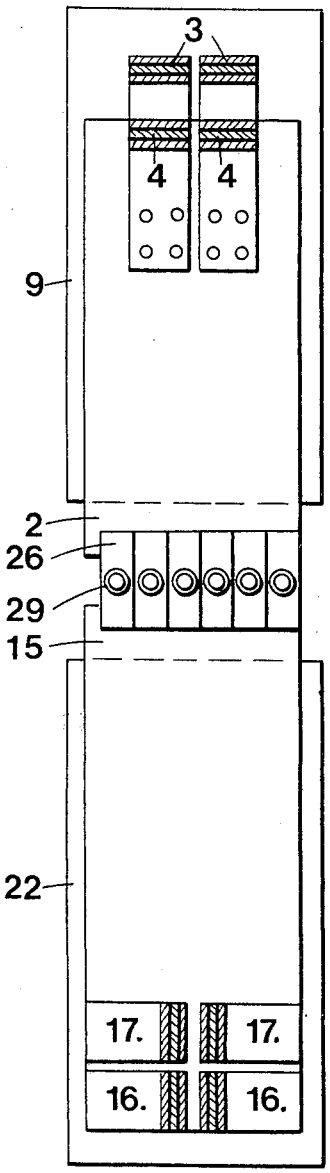
FIG. 2 is a side elevational view, partly in section of the short-circuiter shown in FIG. 1.

FIG. 2 is a schematic section along lines A-B of FIG. 1 showing the stationary contact plates 2 and 15, several movable contacts 26 with their compression spring 29, the two cooling enclosures 9 and 22, as well as the pair of flexible connections 34 and 16 and 17.

Figure 3:
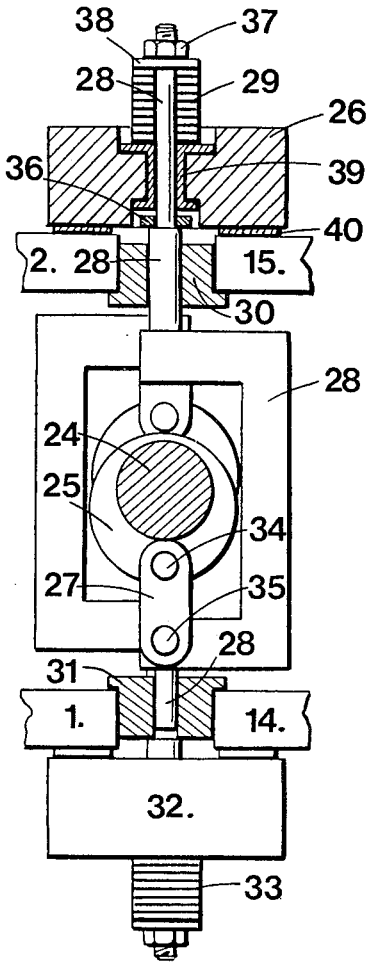
FIG. 3 is a more detailed view of the control mechanism of the movable contacts of the apparatus.

FIG. 3 is a partial sectional view of the driving mechanism of the movable contacts shown FIG. 1. One sees the stationary contact pieces 1 and 14 which cooperate with the movable contacts 32 and the stationary contact plates 2 and 15, cooperating with the movable contacts such as the contact 26, which is drawn through the percompressed compression spring 29 by the nut 37, the washer 38, the bent piece 28, the link 27, the disc 25 and the control shaft 24. The crank is hinged on the axis 34 of the disc 25 and on the axis 35 of the piece 28, which slides in the insulating pieces 30 and 31. The movable contact 26 is insulated from the piece 28, from the stop and regulating washer 36 and from the spring 29 by the insulating bushing 39. The movable contact 26 is provided with contact areas 40, which are of silver on the ordinary contacts and which can be of tungsten or of silver-tungsten alloy, or of ordinary copper, according to the conditions of use of the short-circuiter contacts.

The insulating bushing 39 of the movable contact can be composed preferably of three parts namely, a cylindrical facing of polyfluorethylene having excellent rubbing qualities and two washers having strong resistance to compression.

Figure 4:
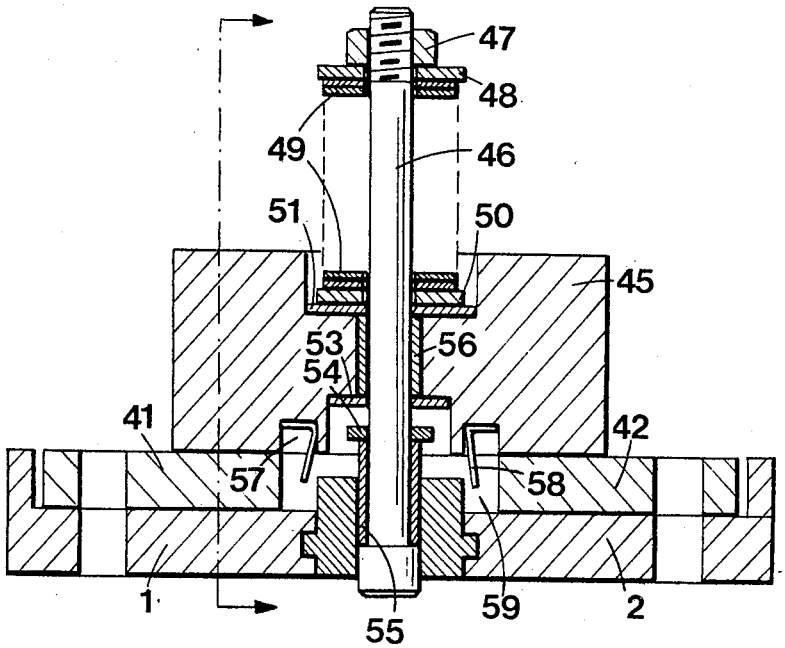
FIGS. 4 and 5 are cross-sectional views of two perpendicular planes of a breaking contact.

FIG. 4 shows two removable stationary contact plates 41 and 42 which are fixed on current feeding plates 15 and 2 by screws not shown and which cooperate with the movable break contact 45, which is operated by a tie-rod 46 through a nut 47, a washer 48, washer-springs 49, a support washer 50 and an insulating washer 51. The movable contact 45 is displaced into its open position by the tie-rod 46 through a washer 53, a regulating collar 54, a cross-piece 55 surrounding the tie-rod 46 which is insulated from the movable contact by an insulating sleeve 56.

The movable contact carries two grooves 57,57 in which are set deflectors 58 of steel, fixed by screws and thus easily replaceable.

In front of the deflectors, recesses 59 are adapted to collect the projections of droplets.

Figure 5:
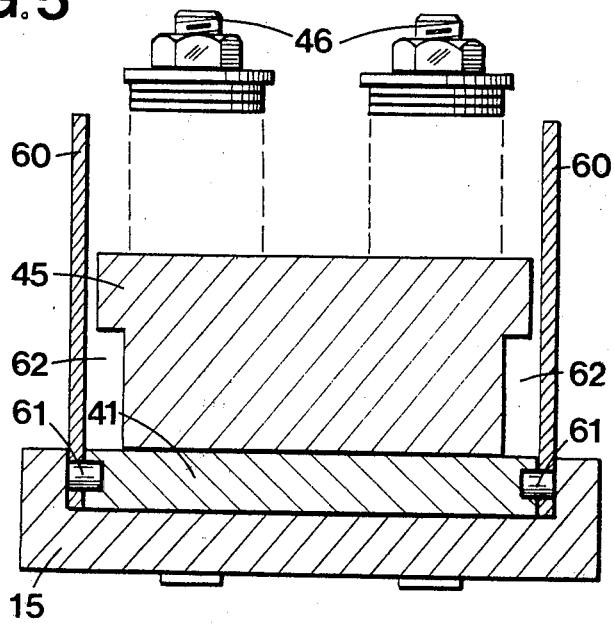

As shown in FIG. 5, the movable contact 45 rests on the removable contact plate 41 carried by the current feeding plate 15. The contact 45 operated by the two tie-rods 46, is surrounded by two partitions 60 for insulating protection. The partitions are made of melamine glass and are held on the contact plate 41 by studs 61.

Recesses 62 are provided in the movable breaking contact to collect the sprays of fusion droplets produced by the breaking contact after their rebound on the protection partitions 60.

The compression springs of the movable contacts are composed preferably by a stack of washer-springs assuring for the ordinary contacts a total pressure of contact of several hundreds of kilograms with a bending path on the order of a millimeter and for the breaking contacts a total support pressure of the same order, but obtained with two springs instead of one, with a bending path clearly longer, for example of three to six millimeters.

In order to improve the conditions of breaking of a short-circuiter according to the invention, the bending paths of the stack of the washer-springs of the different contacts, at closing, including that of the breaking contact, have on each face of the short-circuiter values which rise increasingly when one approaches the breaking contact, for which the bending path of the piling of the washer-springs must always remain clearly the greatest. This condition limits the admissible wear of said contact whose bending path when in new condition may reach, 10 mm. Thus, during a breaking operation, the current is progressively concentrated toward the breaking contact to which can be coupled a pre-break contact which opens just before it and whose stationary plates are removable, said contact being able to be furnished with a special lining of silver-oxide of cadmium.

In the short-circuiter according to the invention, the stationary contact plates, the flexible conductive parts and the pieces for taking the current are preferably made of copper and are silver plated on the contact surfaces. The cooling enclosures and the chassis, which carry the active parts, are preferably made of steel having an austenitic structure which has the advantage of providing a coefficient of thermal dilation practically equal to that of copper.

I claim:

1. Unipolar short-circuiter for electrolysis cells at high direct current at low voltage, characterized by that fact that it includes two sets of movable contact pieces working with two groups of two stationary contact plates arranged in parallel a driving mechanism for the movable contacts, said movable contact pieces, stationary contact plates and driving mechanism being symmetrical in relation to the axis of a single control shaft for the movable contacts, so that said shaft is essentially submitted solely to torsion efforts, each of the groups of two stationary contact plates being connected through a deformable conductor to a current taking plate in order to form a conductor assembly which is surrounded by an enclosure in which a cooling fluid circulates, the only parts of said assembly which are located outside the enclosure being the stationary contact plates cooperating with the movable contacts on the one hand and the contact area of the current taking plate cooperating with the connection area of an electrolysis cell on the other hand, said enclosure including a flexible part to permit a movement of the plate for taking current in relation to the stationary contact plates to compensate for the imprecisions of construction of the cells and the short-circuiter.

2. Short-circuiter according to claim 1, in which the cooling fluid contained in each of the two cooling enclosures is water and can, in case of stoppage of the circulation of the water, enter into a boiling state without appreciable over pressure due to the presence on the high end of each of the enclosures of a discharge valve whose opening entails, preferably the automatic introduction into the enclosure of an anti-foaming agent.

3. Short-circuiter according to claim 1, in which each movable contact is driven through a pre-tightened compression spring, by means of a crank-shaft attached to a sliding piece guided in two insulating pieces located in two places: one insulating piece located near the movable contact, the other insulating piece located near the set of symmetrical movable contacts, said last mentioned insulating piece being near the attachment point of the crank on said sliding piece, the crankpins, carried by the single control shaft, involving alternatively the one and the other of the two sets of movable contacts, said movable contacts being insulated from their control mechanism and from each other so that no transitory circulation of current is possible between any two of the movable contact pieces.

4. Short-circuiter according to claim 3, in which each set of movable contacts includes at least one special breaking contact which closes before the other contacts and which opens after them, said breaking contacts which are wider than ordinary contacts being set off by two crank-shafts and two springs which are more flexible and, in the path of support, substantially longer than ordinary contact pieces.

5. Short-circuiter according to claim 4, in which the stationary and movable parts of the breaking contacts, which are easily replaceable, are provided with contact areas of tungsten, tungsten-silver, or copper, according to the conditions of use namely maximum current, voltage of the electrolysis cell to be short-circuited and frequency of operation.

6. Short-circuiter according to claim 4 including, protective partitions for preventing spray of metallic droplets toward the breaking contact or toward the control mechanism of the breaking contact, said breaking contact having recesses adapted to collect spray droplets blocked or deflected by said partitions carried by the movable breaking contact, said partitions being resistant to the spray droplets at high temperature.

7. Short circuiter according to claim 6 wherein, said breaking contact is provided with grooves in its lower position, metallic deflectors disposed on said grooves, said stationary contact plates being located beneath said breaking contact and provided with recesses beneath said grooves, said deflectors extending into said recesses.

* * * * *

UNITED STATES PATENT AND TRADEMARK OFFICE

CERTIFICATE OF CORRECTION

PATENT NO. : 4,340,794

DATED : July 20, 1982

INVENTOR(S) : Bernard V. Maupas

It is certified that error appears in the above-identified patent and that said Letters Patent are hereby corrected as shown below:

On the title page,

[54] Semi-Conductor For High Continuous Currents

Should read:

[54] Short-Circuiter For High Continuous Currents

Signed and Sealed this

*Fourteenth* Day of *December 1982*

[SEAL]

*Attest:*

GERALD J. MOSSINGHOFF

*Attesting Officer*

*Commissioner of Patents and Trademarks*